US008978620B2

(12) United States Patent
Quinton et al.

(10) Patent No.: US 8,978,620 B2
(45) Date of Patent: Mar. 17, 2015

(54) SEATLESS WET CYLINDER LINER FOR INTERNAL COMBUSTION ENGINE

(75) Inventors: Aaron S. Quinton, Columbus, IN (US); Jerl J. Purcell, Louisa, VA (US); Nathaniel Hassall, Columbus, IN (US); Steven M. Chapman, Columbus, IN (US); Jim D. Kahlenbeck, Columbus, IN (US)

(73) Assignee: Cummins Inc., Columbus, IN (US)

( * ) Notice: Subject to any disclaimer, the term of this patent is extended or adjusted under 35 U.S.C. 154(b) by 49 days.

(21) Appl. No.: 13/370,731

(22) Filed: Feb. 10, 2012

(65) Prior Publication Data

US 2013/0206124 A1 Aug. 15, 2013

(51) Int. Cl.

| | |
|---|---|
| ***F02B 19/00*** | (2006.01) |
| ***F02B 75/08*** | (2006.01) |
| ***F02F 1/10*** | (2006.01) |
| ***F02D 13/06*** | (2006.01) |

(52) U.S. Cl.
USPC ..... 123/271; 123/669; 123/41.84; 123/198 F

(58) Field of Classification Search
CPC ..... F02B 77/02; F02B 3/06; F02B 19/165; F02B 2019/006; F05C 2201/021; F01L 13/0005; F02D 41/0087; F02F 1/16; F02F 1/14
USPC ..... 123/669, 41.84
See application file for complete search history.

(56) References Cited

U.S. PATENT DOCUMENTS

| | | | | |
|---|---|---|---|---|
| 3,046,953 | A | 7/1962 | Dolza | |
| 3,463,056 | A | 8/1969 | Moore et al. | |
| 3,661,135 | A | 5/1972 | Weiss | |
| 3,685,399 | A | 8/1972 | Hoch | |
| 4,099,725 | A | 7/1978 | Wolters | |
| 4,270,440 | A | 6/1981 | Lewis, II | |
| 4,294,203 | A | 10/1981 | Jones | |
| 4,385,595 | A | 5/1983 | Shaw | |
| 4,399,783 | A * | 8/1983 | Hauser, Jr. | 123/193.3 |
| 4,417,549 | A * | 11/1983 | Kazenmaier et al. | 123/41.84 |
| 4,562,799 | A * | 1/1986 | Woods et al. | 123/193.2 |
| 4,638,769 | A * | 1/1987 | Ballheimer | 123/41.84 |
| 5,251,579 | A * | 10/1993 | Morris | 123/41.84 |
| 5,402,754 | A | 4/1995 | Gunnarsson | |
| 5,752,480 | A | 5/1998 | Berggren et al. | |
| 5,979,374 | A | 11/1999 | Jackson | |
| 6,036,194 | A | 3/2000 | Stamper | |
| 6,328,001 | B1 | 12/2001 | Kirtley et al. | |
| 6,532,915 | B2 | 3/2003 | Thompson | |
| 7,533,648 | B2 * | 5/2009 | Moller et al. | 123/193.3 |
| 2010/0139607 | A1 | 6/2010 | Herbst-Dederichs et al. | |

* cited by examiner

*Primary Examiner* — Lindsay Low
*Assistant Examiner* — Syed O Hasan
(74) *Attorney, Agent, or Firm* — Krieg DeVault LLP

(57) ABSTRACT

An apparatus includes an internal combustion engine with an engine block and a cylinder liner housing a piston. The engine block includes at least one cylinder cavity and at least one replaceable cylinder liner positioned within the cylinder cavity. At least two press fit areas create an interference fit between the engine block and the replaceable cylinder liner. One press fit area is located proximate to the top surface of the engine block and the other press fit area is located in the engine block at the opposite end of the cylinder liner. A storage volume is formed between the press fit areas by the outer surface of the cylinder liner and the surface of the engine block defining the cylinder cavity.

20 Claims, 2 Drawing Sheets

SEATLESS WET CYLINDER LINER FOR INTERNAL COMBUSTION ENGINE

TECHNICAL FIELD

The present application relates to cylinder liners for internal combustion engines, and more particularly, but not exclusively to seatless wet replaceable cylinder liners.

BACKGROUND

Present approaches to removable cylinder liners suffer from a variety of drawbacks, limitations, disadvantages and problems including those respecting machinability and amount of material used in the engine block to create features for seating of the cylinder liner and coolant passages. Therefore, there is a need for unique and inventive apparatuses, systems and methods for cylinder liners.

SUMMARY

One embodiment of the present application is a unique replaceable cylinder liner for an internal combustion engine. Other embodiments include apparatuses, systems, devices, hardware, methods, and combinations for seatless wet cylinder liners. Further embodiments, forms, features, aspects, benefits, and advantages shall become apparent from the description and figures provided herewith.

DETAILED DESCRIPTION OF THE ILLUSTRATED EMBODIMENTS

Figure 1:
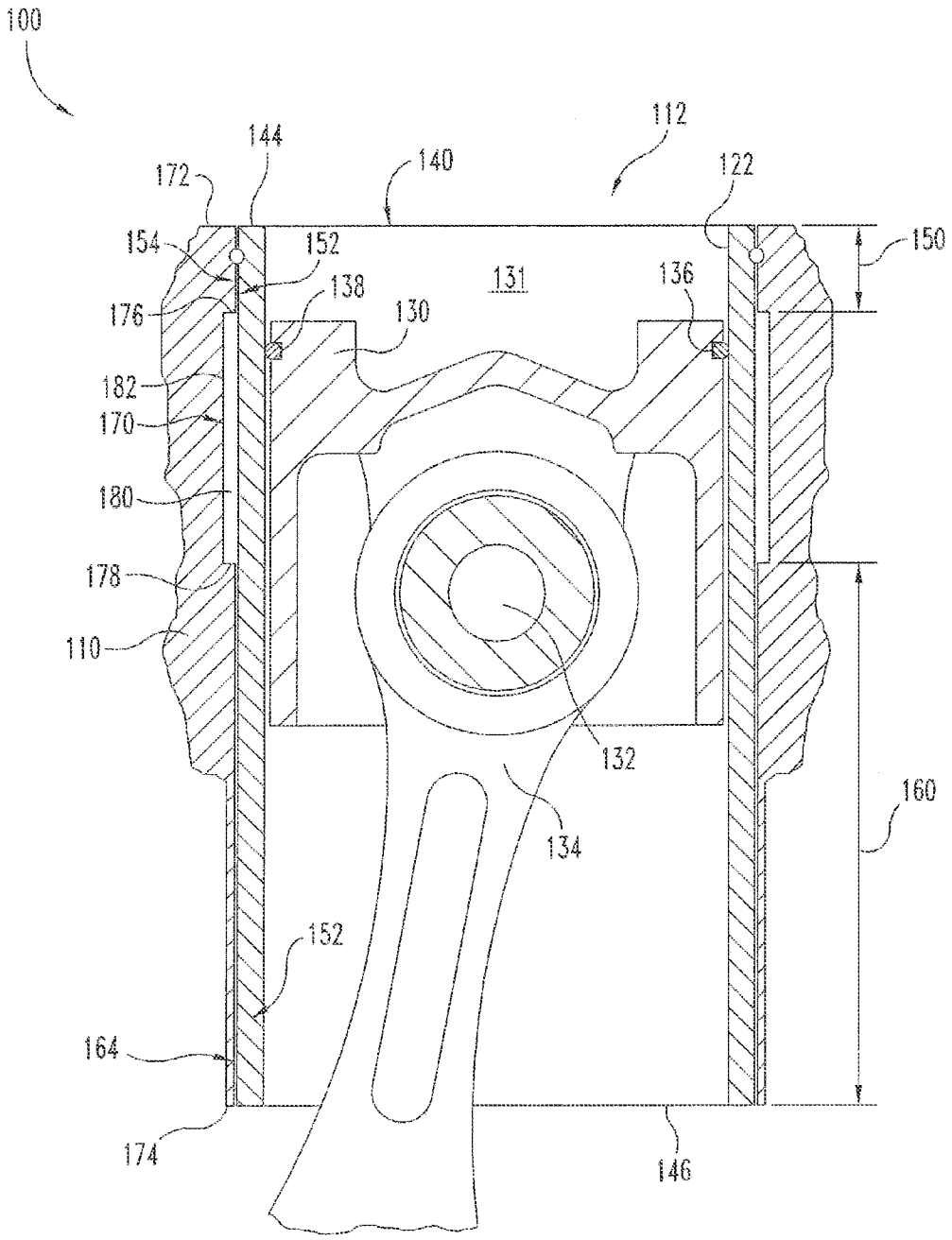
FIG. 1 is an elevational cross-sectional illustration of a seatless wet cylinder liner and piston positioned in an engine block.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

One embodiment of the present application includes an internal combustion engine with an engine block and a cylinder liner housing a piston. The engine block includes at least one cylinder cavity and at least one replaceable cylinder liner positioned within the cylinder cavity. At least two press fit areas create an interference fit between the engine block and the replaceable cylinder liner. One press fit area is located proximate to the top surface of the engine block and the other press fit area is located in the engine block at the opposite end of the cylinder liner. A storage volume is formed between the press fit areas by the outer surface of the cylinder liner and the surface of the engine block defining the cylinder cavity. The press fit areas resist the axial load of the cylinder liner within the cylinder cavity without features such as a seat or other structure protruding from the engine block into the cylinder cavity creating an axial abutment feature for the cylinder liner. The press fit areas also seal the storage volume to prevent passage of, for example, coolant from the storage volume out of the cylinder cavity. In one embodiment, a redundant seal is provided between the cylinder liner and the engine block at the press fit area proximate the top surface or burn plate of the block.

FIG. 1 depicts an elevational cross sectional view of a portion of an internal combustion engine 100 including an engine block 110, of which a portion is shown. Engine block 110 includes at least one cylinder cavity 112 receiving cylinder liner 140 defining a combustion chamber 131. Internal combustion engine 100 may be designed with a single cylinder or multiple cylinders. Some embodiments, for example, contemplate an engine 100 with pairs of cylinders ranging from two to twenty-four cylinders, although any number of cylinders is contemplated. Engine block 110 includes a piston 130 in combustion chamber 131 slidably received within the inner diameter 122 of cylinder liner 140. A top piston ring 136 is located within ring groove 138 of piston 130 and contacts inner diameter 122 of cylinder liner 140, and provides a lower seal for combustion chamber 131. A wrist pin 132 rotatably connects piston 130 to a connecting rod 134. Connecting rod 134 is connected to a crankshaft (not shown) in a conventional manner.

During operation of internal combustion engine 100, the crankshaft rotates to force piston 130 to move up and down in combustion chamber 131 under high combustion temperatures and pressures. These conditions, among others, cause cylinder liner 140 to become worn, cracked or otherwise deficient over time. Cylinder liners 140 are readily replaceable to restore appropriate clearances for the piston and other components of the cylinder, allowing for efficiency and performance improvements. In one embodiment, cylinder liner 140 is cast and cylinder cavity 112 only requires a modest amount of machining in engine block 110 to provide sliding, sealing and contact surfaces as well as a storage volume around cylinder liner 140, although other methods of fabrication are contemplated.

Cylinder liner 140 may be inserted into cylinder cavity 120 under conditions that create at least two press fit areas. A press fit, also known as an interference fit or friction fit, for example, creates an axial hold where adjoining parts share the same space by creating a slight elastic deformation and a compression force between the adjoining parts. Compression from the press fit increases the friction between the adjoining parts to a point where independent movement of the adjoining parts is not possible under normal operating conditions. Press fits between the cylinder liner 140 and engine block 110 may be created using physical presses, principles of thermal expansion or other suitable method.

In the illustrated embodiment, assembly of cylinder liner 140 with engine block 110 in cylinder cavity 120 includes a first press fit area 150 and a second press fit area 160. First press fit area 150 and second press fit area 160 create connections of cylinder liner 140 with engine block 110 that retain cylinder liner 140 in cylinder cavity 112 in a manner that resists axial movement of cylinder liner 140 relative to engine block 110 under operating conditions for engine 100. Friction within the press fit areas 150, 160 maintains cylinder liner 140 in axial position without physical stop features such as flanges, ledges, rims, projecting edges, ridges and the like extending from engine block 110 into cylinder cavity 112. Elimination of features in cylinder cavity 112 that create an axial abutment of cylinder liner 140 with engine block 110 reduces the amount of machining required to create cylinder cavity 112 and the amount of material required by engine block 110.

Press fit areas 150, 160 are provided by arranging the inner diameter of cylinder cavity 112 to be slightly smaller than the outer diameter of cylinder liner 140 so that force must be applied to cylinder liner 140 to insert it into cylinder cavity 112 to overcome the interference therebetween. In the illustrated embodiment, first press fit area 150 is formed by a cylinder liner outer diameter 152 and a first cylinder cavity inner diameter 154. Second press fit area 160 is formed by cylinder liner outer diameter 152 and a second cylinder cavity inner diameter 164. First cylinder cavity inner diameter 154 may be the same as or differ from second cylinder cavity inner diameter 164. Cylinder liner outer diameter 152 is slightly greater than first and second cylinder cavity inner diameters 154, 164 of the corresponding portions of cylinder cavity 112 into which cylinder liner 140 is press fit. Cylinder liner 140 is press fit into cylinder cavity 112 until at least a portion of upper end 144 of cylinder liner 140 is aligned with or flush with the burn plate or top surface 172 of engine block 110. Head gasket 194 can then be positioned along top surface 172 across the junction of cylinder liner 140 with engine block 110 and secured in position with engine head 196.

Figure 2:
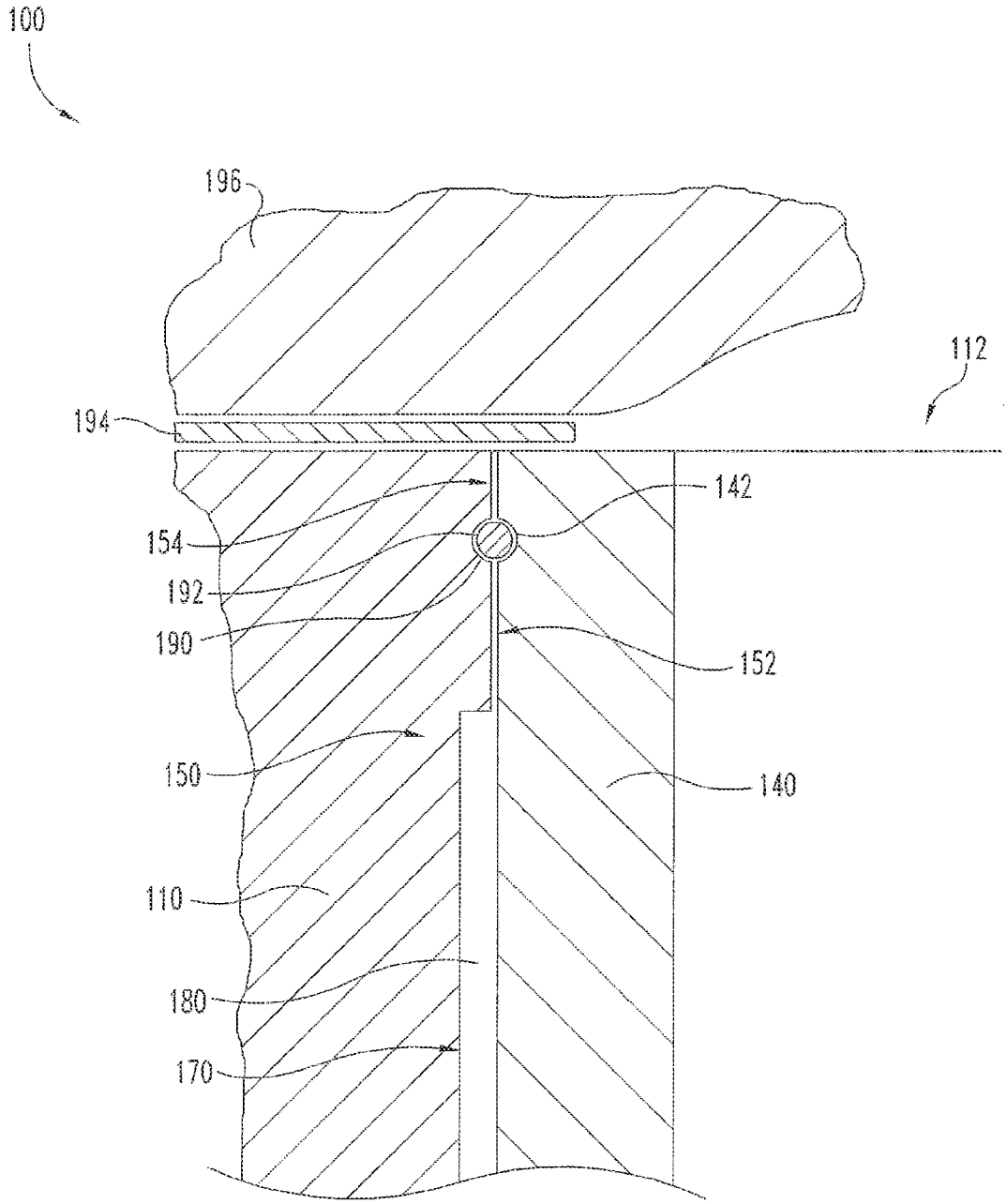
FIG. 2 is an enlarged elevational cross-sectional illustration of a portion of the FIG. 1 cylinder liner without a piston, and further showing a portion of a cylinder head and head gasket.

In the illustrated embodiment, the length of press fit area 150 along cylinder liner 140 and cylinder cavity 112 is substantially less than the length of second press fit area 160, and the press fit of cylinder liner 140 with engine block 110 is substantially continuous along the respective lengths of press fit areas 150, 160. In other embodiments, the lengths of the press fit areas 150, 160 are the same or approximately the same. In still other embodiments, the press fit between cylinder liner 140 and block 110 along one or both of press fit areas 150, 160 includes one or more discontinuities. For example, as shown in further detail in FIG. 2, press fit area 150 includes a discontinuity formed by recess 142 in cylinder liner outer diameter 152 and recess 190 in first cylinder cavity inner diameter 154. A circumferential seal 192 is positioned in recesses 142, 190. In one embodiment, seal 192 is an elastomeric O-ring, although other types of seals are also contemplated and not precluded.

A jacket region 170 is formed by cylinder cavity 112 around cylinder liner 140 via an undercut in engine block 110 between top end 172 and bottom end 174 of cylinder cavity 112. Jacket region 170 extends along a sufficient portion of the axial length of cylinder liner 140 to provide a storage volume 180 that receives coolant, insulation or other media that provides adequately heat transfer from cylinder liner 140 during engine operation. In the illustrated embodiment, jacket region 170 includes an upper lip 176 facing an opposite bottom lip 178 and a jacket surface 182 extending between lips 176, 178. Lips 176, 178 extend radially outwardly from cylinder liner 140 so as to not protrude into cylinder cavity 112, and each lip 176, 178 defines an end of the respective press fit area 150, 160. For example, press fit area 150 extends from lip 176 to top surface 172 and press fit area 160 extends from lip 178 to bottom end 146 of cylinder liner 140.

The storage volume 180 allows use of a cooling or insulation media that creates a "wet" environment in which cylinder liner 140 operates. Storage volume 180 is sealed at opposite upper and lower ends by first press fit area 150 and second press fit area 160. Additional sealing of storage volume 180 can be provided by seal 190. In any event, coolant, insulation or other media in the storage volume 180 is sealed to prevent leakage to head gasket 194 and engine head 196. Seal 192 provides a redundant seal that assists in maintaining the sealing of storage volume 180 as engine 100 temperatures vary between hot and cold.

A profile along cylinder liner 140 is created by the two press fit areas 150, 160 spaced from one another along the length of cylinder liner 140 by storage volume 180. While two press fit areas are shown in FIG. 1, one or more additional press fit areas may be provided that form multiple storage volumes along length of cylinder liner 140. It is also contemplated in one embodiment that the cooling media in storage volume 180 is shared with the engine cooling system, where coolant flows through storage volume 180 to maintain a suitable operating temperature for cylinder liner 140, engine block 110 and other components. Cylinder liner 140 can be in direct contact with the coolant to provide improved heat transfer.

The profile along cylinder liner 140 includes a smaller axial length of press fit area 150 than the axial length of press fit area 160, allowing cooling media in storage volume 180 to be closer to seal 192 and head gasket 194 and reduce the temperature of these components during engine operation. In addition, this smaller length for press fit area 150 aligns the upper end of storage volume 180 with the top dead center position of piston ring 136 to remove heat from piston ring 136. The greater axial length of press fit area 160 provides sufficient frictional forces in addition to those provided by press fit area 150 to maintain an axial hold of cylinder liner 140 during engine operation. In one embodiment, the axial length of press fit area 160 is at least twice the length of press fit area 150.

The arrangement of cylinder liner 140 and cylinder cavity 112 allows cylinder liner 140 to have a substantially constant outer diameter 152 from top end 144 to opposite second end 146, with only limited interruption, such as that formed by recess 142. Furthermore, cylinder cavity 112 can be provided with a continuous inner diameter 152, 154 except where the inner diameters are interrupted by jacket region 170. However, interruptions in the interior space defined by cylinder cavity 112 that receives cylinder liner 140 is free of features such as lips, ledges, or abutments, protruding into cylinder cavity 112 that would, if present, provide an axial stop when contacted by cylinder liner 140.

According to one aspect, an apparatus comprises an internal combustion engine including an engine block and at least one cylinder cavity in the engine block. The cylinder cavity includes an upper end portion and a lower end portion and an undercut region therebetween. At least one replaceable cylinder liner is received in the cylinder cavity. The cylinder liner includes a first press fit area located proximate a first end of the cylinder liner in press fit engagement with the upper end portion of the cylinder cavity and a second press fit area spaced from the first press fit area in press fit engagement with the lower end portion of the cylinder cavity. A storage volume is formed by the cylinder liner and the undercut region between the first and second press fit areas, wherein the first press fit area and the second press fit area axially secure the cylinder liner in the cylinder cavity.

In one refinement of this aspect, a coolant or insulation is provided in the storage volume. In another refinement of this aspect, the cylinder liner includes an annular recess in an outer surface of the cylinder liner in the first press fit area and a seal in the annular recess between the cylinder liner and the engine block. In another refinement of this aspect, the cylinder liner includes an outer diameter that is constant from the first end of the cylinder liner to an opposite second end of the cylinder liner located proximate the second press fit area, and the cylinder cavity includes a first inner diameter along the upper end portion and a second inner diameter along the lower end portion, wherein the outer diameter is greater than the first and second inner diameters. In another refinement of this aspect, the second press fit area has an axial length along the cylinder liner that is at least twice a length of the first press fit area along the cylinder liner. In yet another refinement of this aspect, the cylinder cavity is free of features that create an axial abutment of the cylinder liner in the cylinder cavity.

According to another aspect, an internal combustion engine includes an engine block and at least one cylinder cavity in the engine block. The cylinder cavity includes an upper end portion and a lower end portion. At least one replaceable cylinder liner is positioned in the cylinder cavity with a first press fit between the cylinder cavity and the cylinder liner proximate a first end of the cylinder liner and with a second press fit between the cylinder cavity and the cylinder liner proximate to a second end of the cylinder liner. The first press fit and the second press fit axially retain the cylinder liner against movement relative to the engine block while the cylinder cavity is free of features providing an axial abutment with the cylinder liner in the cylinder cavity.

In one refinement of this aspect, the cylinder liner has an outer diameter extending from the first end to the second end of the cylinder liner and the cylinder cavity has a first inner diameter at the first press fit and a second inner diameter at the second press fit, the outer diameter being greater than the first and second inner diameters. In one further refinement, the first and second inner diameters are the same.

In another refinement of this aspect, the cylinder cavity includes an undercut between the first press fit and the second press fit. The undercut defines a storage volume around the cylinder liner between the first and second press fits for receiving a heat transfer media. In one further refinement, the first press fit and the second press fit seal the storage volume. In another further refinement, the first press fit extends completely around the cylinder liner from a burn plate of the engine block to the undercut and the second press fit extends completely around the cylinder liner from the undercut to the second end of the cylinder liner.

In another refinement of this aspect, the cylinder liner includes an annular recess in an outer surface of the cylinder liner in the first press fit and a seal is positioned in the annular recess between the cylinder liner and the engine block.

In yet another refinement of this aspect, the second press fit has an axial length along the cylinder liner that is at least twice a length of the first press fit along the cylinder liner.

According to another aspect, a method comprises: forming a cylinder cavity in an engine block, wherein the cylinder cavity extends from a top surface of the engine block and includes a length having a first inner diameter portion extending from the top surface to an undercut region, and the undercut region extends along the length from the first inner diameter portion to a second inner diameter portion of the cylinder cavity, wherein the second inner diameter portion extends along the length of the cylinder cavity; placing a replaceable cylinder liner within the cylinder cavity; and establishing a fixed axial position of the cylinder liner relative to the engine block with a first press fit between an outer diameter of the cylinder liner and the first inner diameter portion of the cylinder cavity and a second press fit between the outer diameter of the cylinder liner and the second inner diameter portion of the cylinder cavity, wherein a storage volume is formed by the outer diameter of the cylinder liner and the undercut region between the first and second press fit areas.

In one refinement of this aspect, the cylinder liner includes a recess in the outer diameter thereof, the recess being aligned with the first inner diameter portion and the recess including a seal therein. In another refinement of this aspect, the second inner diameter portion has a length that is at least twice a length of the first inner diameter portion. In yet another refinement of this aspect, the first and second inner diameters are the same and the first interference fit and the second interference fit seal the storage volume.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising: an internal combustion engine including an engine block and at least one cylinder cavity in the engine block, wherein the cylinder cavity includes an upper end portion and a lower end portion and an undercut region there between; at least one replaceable cylinder liner received in the cylinder cavity, wherein the cylinder liner includes a first press fit area located proximate a first end of the cylinder liner in press fit engagement with the upper end portion of the cylinder cavity and a second press fit area spaced from the first press fit area in press fit engagement with the lower end portion of the cylinder cavity; a storage volume formed by the cylinder liner and the undercut region between the first and second press fit areas, wherein the first press fit area and the second press fit area axially secure the cylinder liner in the cylinder cavity; and the cylinder cavity is free of features providing an axial abutment with the cylinder liner in the cylinder cavity.

2. The apparatus of claim 1, further comprising a coolant in the storage volume.

3. The apparatus of claim 1, wherein the cylinder liner includes an annular recess in an outer surface of the cylinder liner in the first press fit area.

4. The apparatus of claim 3, further comprising a seal in the annular recess between the cylinder liner and the engine block.

5. The apparatus of claim 1, wherein:

the cylinder liner further includes an outer diameter that is constant from the first end of the cylinder liner to an opposite second end of the cylinder liner located proximate the second press fit area; and the cylinder cavity includes a first inner diameter along the upper end portion and a second inner diameter along the lower end portion, wherein the outer diameter of the cylinder liner is greater than the first and second inner diameters.

6. The apparatus of claim 5, wherein the first and second inner diameters are the same.

7. The apparatus of claim 1, wherein the second press fit area has an axial length along the cylinder liner that is at least twice a length of the first press fit area along the cylinder liner.

8. The apparatus of claim 1, wherein the cylinder cavity is free of features providing an axial abutment of the cylinder liner in the cylinder cavity.

9. An apparatus comprising:

an internal combustion engine including an engine block and at least one cylinder cavity in the engine block, wherein the cylinder cavity includes an upper end portion and a lower end portion; and at least one replaceable cylinder liner positioned in the cylinder cavity with a first press fit between the cylinder cavity and the cylinder liner proximate a first end of the cylinder liner and a second press fit between the cylinder cavity and the cylinder liner proximate to a second end of the cylinder liner, wherein the first press fit and the second press fit axially retain the cylinder liner against movement relative to the engine block and the cylinder cavity is free of features providing an axial abutment with the cylinder liner in the cylinder cavity.

10. The apparatus of claim 9, wherein:

the cylinder liner has an outer diameter extending from the first end to the second end of the cylinder liner; and the cylinder cavity has a first inner diameter at the first press fit and a second inner diameter at the second press fit, the outer diameter being greater than the first and second inner diameters.

11. The apparatus of claim 10, wherein the first and second inner diameters are the same.

12. The apparatus of claim 9, wherein the cylinder cavity includes an undercut between the first press fit and the second press fit, the undercut defining a storage volume around the cylinder liner between the first and second press fits for receiving a heat transfer media.

13. The apparatus of claim 12, wherein the first press fit and the second press fit seal the storage volume.

14. The apparatus of claim 12, wherein the first press fit extends completely around the cylinder from a burn plate of the engine block to the undercut and the second press fit extends completely around the cylinder from the undercut to the second end of the cylinder liner.

15. The apparatus of claim 9, wherein the cylinder liner includes an annular recess in an outer surface of the cylinder liner in the first press fit and further comprising a seal in the annular recess between the cylinder liner and the engine block.

16. The apparatus of claim 9, wherein the second press fit has an axial length along the cylinder liner that is at least twice a length of the first press fit along the cylinder liner.

17. A method comprising: forming a cylinder cavity in an engine block, wherein the cylinder cavity extends from a top surface of the engine block and includes a length having a first inner diameter portion extending from the top surface to an undercut region, and the undercut region extends along the length from the first inner diameter portion to a second inner diameter portion of the cylinder cavity, wherein the second inner diameter portion extends along the length of the cylinder cavity; placing a replaceable cylinder liner within the cylinder cavity; establishing a fixed axial position of the cylinder liner relative to the engine block with a first press fit area forming a press fit engagement between an outer diameter of the cylinder liner and the first inner diameter portion of the cylinder cavity and a second press fit area forming a press fit engagement between the outer diameter of the cylinder liner and the second inner diameter portion of the cylinder cavity, wherein a storage volume is formed by the outer diameter of the cylinder liner and the undercut region between the first and second press fit areas; and the cylinder cavity is free of features providing an axial abutment with the cylinder liner in the cylinder cavity.

18. The method of claim 17, wherein the cylinder liner includes a recess in the outer diameter thereof, the recess being aligned with the first inner diameter portion and the recess including a seal therein.

19. The method of claim 17, wherein the first and second inner diameters are the same and the first press fit area and the second press fit area seal the storage volume and the second inner diameter portion has a length that is at least twice a length of the first inner diameter portion.

20. The method of claim 17, wherein the fixed axial position is established without axially abutting the cylinder liner with the engine block in the cylinder cavity.

* * * * *